US009572383B2

(12) United States Patent
Kleinert

(10) Patent No.: US 9,572,383 B2
(45) Date of Patent: Feb. 21, 2017

(54) CYCLING GLOVE

(75) Inventor: James M. Kleinert, Turners Station, KY (US)

(73) Assignee: Hillerich & Bradsby Co., Louisville, KY (US)

( * ) Notice: Subject to any disclaimer, the term of this patent is extended or adjusted under 35 U.S.C. 154(b) by 1054 days.

(21) Appl. No.: 13/042,346

(22) Filed: Mar. 7, 2011

(65) Prior Publication Data

US 2012/0227157 A1 Sep. 13, 2012

(51) Int. Cl.

| | |
|---|---|
| ***A41D 13/00*** | (2006.01) |
| ***A41D 19/015*** | (2006.01) |
| ***A41D 13/08*** | (2006.01) |
| ***A63B 71/14*** | (2006.01) |

(52) U.S. Cl.

CPC ..... *A41D 19/01523* (2013.01); *A41D 13/081* (2013.01); *A63B 71/141* (2013.01); *A41D 2600/104* (2013.01)

(58) Field of Classification Search

CPC ..... A41D 19/01523; A41D 13/081; A41D 2600/104; A63B 71/141

USPC ..... 2/161.1, 19, 161, 16, 159, 20, 2/161.2,2/161.6, 163

See application file for complete search history.

(56) References Cited

U.S. PATENT DOCUMENTS

| | | | |
|---|---|---|---|
| 325,968 | A | 9/1885 | Rawlings |
| 385,728 | A | 7/1888 | Sauer |
| RE12,996 | E | 7/1909 | Peach |
| 1,018,271 | A | 2/1912 | Rogers |
| 1,202,705 | A | 10/1916 | Goldsmith et al. |
| 1,435,478 | A | 11/1922 | Kennedy |
| 1,436,131 | A | 11/1922 | Whitley |
| 1,496,824 | A | 6/1924 | Nixon, Jr. |
| 1,525,298 | A | 2/1925 | Hartman |
| 1,552,080 | A | 9/1925 | Rainey |
| 1,562,176 | A | 11/1925 | Latina |
| RE16,272 | E | 2/1926 | Green |

(Continued)

FOREIGN PATENT DOCUMENTS

| | | |
|---|---|---|
| CA | 2683608 A1 | 4/2010 |
| GB | 710394 | 6/1954 |

(Continued)

OTHER PUBLICATIONS

Knecht, Petra: "Funktionstextilien" 2003, Deutscher Fachverlag GMBH, Frankfurt AM Main, XP002473095, pp. 62,63 and pp. 282, 283.

(Continued)

*Primary Examiner* — Khaled Annis

(74) *Attorney, Agent, or Firm* — Middleton Reutlinger; Alexander P. Brackett

(57) ABSTRACT

A glove particularly useful for cycling includes a plurality of finger elements a thumb element a dorsal side panel and a palmar side panel. The finger elements cover the fingers the thumb elements cover a thumb the dorsal side panel covers a back or dorsal side of the hand and the palmar side panel covers a palm of the hand. Shock absorbing pads are provided on the palmar side of the glove to extend along opposed sides of the ulnar nerve when in a use condition. Moreover one of the ulnar protective pads is placed generally between the ulnar and the median nerves and thereby off loads the stress on the ulnar nerve in the wrist area of the wearer when a wearer is gripping objects such as the handle bars of a bicycle or the like.

8 Claims, 6 Drawing Sheets

(56) References Cited

U.S. PATENT DOCUMENTS 1,594,304 A 7/1926 Klahn et al.
D72,069 S 2/1927 Meyers
1,716,221 A 6/1929 Fernie
1,841,193 A 1/1932 Lidston
1,900,395 A 3/1933 Gitt
2,036,413 A 4/1936 Herbruck
2,083,935 A 6/1937 Arnold
2,258,999 A 10/1941 Nunn
2,344,080 A 3/1944 Burgett
2,369,115 A 2/1945 Bloom
2,465,136 A 3/1949 Troccoli
2,528,802 A 11/1950 Turner
2,558,544 A 6/1951 Delsalle
2,567,489 A 9/1951 Lewis
2,636,172 A 4/1953 Stobbe
2,750,594 A 6/1956 Denkert
2,975,429 A 3/1961 Newman
2,980,915 A 4/1961 Peterson
3,042,929 A 7/1962 Kobos
3,096,523 A 7/1963 Bruchas
3,164,841 A 1/1965 Burtoff
3,175,226 A 3/1965 Weinberg
3,273,165 A 9/1966 Sperandeo
3,290,695 A 12/1966 Burtoff
3,300,787 A 1/1967 Denkert
3,411,222 A 11/1968 Williams
D213,287 S 2/1969 Khazzam
3,458,867 A 8/1969 Moore et al.
3,532,344 A 10/1970 Masstab
3,564,613 A 2/1971 Fowler
3,576,036 A 4/1971 Latina
3,588,915 A 6/1971 Latina
3,605,117 A 9/1971 Latina
3,606,614 A 9/1971 Dimitroff
3,649,966 A 3/1972 Shields
3,707,730 A 1/1973 Slider
3,918,096 A 11/1975 Lim
D240,671 S 7/1976 McTear
D240,672 S 7/1976 McTear
3,997,922 A 12/1976 Huhta
3,997,992 A 12/1976 Anderson
4,027,339 A 6/1977 Brucker
4,038,787 A 8/1977 Bianchi
4,042,975 A 8/1977 Elliott, Jr. et al.
4,051,552 A 10/1977 Widdemer
4,051,553 A 10/1977 Howard
4,067,063 A 1/1978 Ettinger
4,068,312 A 1/1978 Ledesma
4,084,584 A 4/1978 Detty
4,095,292 A 6/1978 Klein
D248,898 S 8/1978 DeLeone et al.
4,137,572 A 2/1979 Jansson et al.
4,187,557 A 2/1980 Tombari
4,201,203 A 5/1980 Applegate
4,250,578 A 2/1981 Barlow
4,272,849 A 6/1981 Thurston et al.
4,272,850 A 6/1981 Rule
4,287,885 A 9/1981 Applegate
4,329,741 A 5/1982 Bach
4,346,481 A 8/1982 Latina
4,438,532 A 3/1984 Campanella et al.
4,445,507 A 5/1984 Eisenberg
4,524,464 A 6/1985 Primiano et al.
4,546,495 A 10/1985 Castillo
4,561,122 A 12/1985 Stanley et al.
4,570,269 A 2/1986 Berlese
4,589,146 A 5/1986 Taylor
4,590,625 A 5/1986 Keim
4,630,318 A 12/1986 Aoki
4,663,783 A 5/1987 Obayashi
4,665,561 A 5/1987 Aoki
4,677,698 A 7/1987 Angas
4,684,123 A 8/1987 Fabry
4,691,387 A 9/1987 Lopez
4,700,404 A 10/1987 Potvin
D294,984 S 3/1988 Green
4,747,163 A 5/1988 Dzierson
4,748,690 A 6/1988 Webster
4,751,749 A 6/1988 Cowhey
4,766,612 A 8/1988 Patton, Sr.
4,815,147 A 3/1989 Gazzano et al.
4,843,651 A 7/1989 Gramza et al.
4,847,915 A 7/1989 Keene
4,850,053 A 7/1989 Tepley et al.
4,864,659 A 9/1989 Morris
4,864,660 A 9/1989 Sawyer
4,891,845 A 1/1990 Hayes
4,896,376 A 1/1990 Miner
4,911,433 A 3/1990 Walker et al.
4,930,162 A 6/1990 Côté
4,958,384 A 9/1990 McCrane
4,967,418 A 11/1990 Marcotte
5,004,227 A 4/1991 Hoffman
5,016,286 A 5/1991 Henriksen
5,028,050 A 7/1991 Freyer
5,031,238 A 7/1991 Hayes
D320,871 S 10/1991 Bothof, III et al.
D320,872 S 10/1991 McCrane
5,058,209 A 10/1991 Eisenberg
5,067,175 A 11/1991 Gold
5,083,361 A 1/1992 Rudy
5,107,544 A 4/1992 Capatosto
D328,369 S 7/1992 Hong
5,136,725 A 8/1992 Montero
5,146,624 A 9/1992 Brückner
5,168,576 A 12/1992 Krent et al.
5,168,578 A 12/1992 Stanley
D332,845 S 1/1993 Johnston
5,175,886 A 1/1993 Suk
5,195,188 A 3/1993 Bourdeau et al.
5,214,799 A 6/1993 Fabry
5,218,718 A 6/1993 Chih
5,218,719 A 6/1993 Johnson
D338,280 S 8/1993 Krent et al.
5,237,703 A 8/1993 Brine et al.
5,253,365 A 10/1993 Clevenhagen
5,257,418 A 11/1993 Jaskiewicz
5,309,573 A 5/1994 Solar et al.
5,323,490 A 6/1994 Yarbrough
5,328,652 A 7/1994 Thomson
5,329,639 A 7/1994 Aoki
5,330,391 A 7/1994 Mitchell
D351,050 S 9/1994 Sheldon
5,345,609 A 9/1994 Fabry et al.
5,379,460 A 1/1995 Aoki
D356,203 S 3/1995 Mitch
D360,284 S 7/1995 Paffett et al.
5,435,008 A 7/1995 Shane
5,442,815 A 8/1995 Cordova et al.
5,442,816 A 8/1995 Seketa
D362,927 S 10/1995 McCrane
5,459,878 A 10/1995 Gold
5,462,280 A 10/1995 Dickerson
5,471,682 A 12/1995 Robins et al.
5,477,558 A 12/1995 Völker et al.
5,488,739 A 2/1996 Cardinal
5,490,290 A 2/1996 Gold
D367,731 S 3/1996 Estwanik
5,500,955 A 3/1996 Gongea
5,511,242 A 4/1996 Bianchi
5,511,243 A 4/1996 Hall et al.
5,511,244 A 4/1996 Shikatani
5,530,967 A 7/1996 Cielo
5,551,083 A 9/1996 Goldsmith
5,557,803 A 9/1996 Granich et al.
5,557,806 A 9/1996 Caswell et al.
5,564,122 A 10/1996 Wagner
5,575,005 A 11/1996 Walker et al.
5,581,809 A 12/1996 Mah
5,592,688 A 1/1997 LaRonge et al.
D378,148 S 2/1997 Haney
5,598,582 A 2/1997 Andrews et al.
5,600,853 A 2/1997 Yewer, Jr.
5,608,912 A 3/1997 Cumberland

(56) References Cited

U.S. PATENT DOCUMENTS 5,608,915 A 3/1997 Libit
5,634,214 A 6/1997 St. Ville
5,638,548 A 6/1997 Kawakami
5,640,712 A 6/1997 Hansen et al.
5,644,795 A 7/1997 Landis et al.
5,655,221 A 8/1997 Worischeck
5,655,226 A 8/1997 Williams
5,659,897 A 8/1997 Satoh et al.
D385,667 S 10/1997 Goldsmith
5,675,839 A 10/1997 Gordon et al.
5,678,245 A 10/1997 Rector et al.
5,682,613 A 11/1997 Dinatale
5,685,014 A 11/1997 Dapsalmon
5,692,242 A 12/1997 Tekerman et al.
5,694,642 A 12/1997 Rector et al.
5,697,103 A 12/1997 Wiggins
5,697,104 A 12/1997 Welton
D389,283 S 1/1998 Goldsmith
5,708,979 A 1/1998 Redwood et al.
5,715,539 A 2/1998 Benecki et al.
5,717,994 A 2/1998 Goldsmith
5,717,995 A 2/1998 Murai
5,720,047 A 2/1998 Spitzer
5,745,916 A 5/1998 Linner
5,761,745 A 6/1998 Sato
5,781,929 A 7/1998 Shikatani
5,781,931 A 7/1998 Lee
5,785,617 A 7/1998 MacKay, Jr.
5,787,506 A 8/1998 Wilder et al.
5,790,980 A 8/1998 Yewer, Jr.
5,799,327 A 9/1998 Clevenhagen
5,802,614 A 9/1998 Melone, Jr.
5,806,092 A 9/1998 Shikatani
5,809,571 A 9/1998 Spitzer
5,815,839 A 10/1998 Safford
5,815,840 A 10/1998 Hamlin
5,819,312 A 10/1998 Snyder et al.
5,819,313 A 10/1998 McCrane
5,855,022 A 1/1999 Storto
5,878,436 A 3/1999 Jones
5,884,329 A 3/1999 Goldsmith et al.
5,887,282 A 3/1999 Lenhart
5,893,172 A 4/1999 Haynes et al.
5,898,938 A 5/1999 Baylor et al.
5,898,942 A 5/1999 Anderson
5,926,847 A 7/1999 Eibert
5,946,720 A 9/1999 Sauriol
5,963,985 A 10/1999 Behr et al.
5,983,396 A 11/1999 Morrow et al.
5,987,642 A 11/1999 Webster
5,987,646 A 11/1999 Bolmer
D417,757 S 12/1999 Aoki
5,996,117 A 12/1999 Goldsmith et al.
6,000,059 A 12/1999 Abts
6,006,751 A 12/1999 Spitzer
6,012,170 A 1/2000 Kim
6,016,571 A 1/2000 Guzman et al.
D420,173 S 2/2000 Aoki
D420,174 S 2/2000 Aoki
D420,202 S 2/2000 Redwood et al.
6,035,443 A 3/2000 Green
6,041,438 A 3/2000 Kirkwood
6,049,910 A 4/2000 McCarter
6,052,827 A 4/2000 Widdemer
6,065,150 A 5/2000 Huang
D426,922 S 6/2000 Redwood et al.
6,085,352 A 7/2000 Martin
6,088,835 A 7/2000 Perkins et al.
6,098,200 A 8/2000 Minkow et al.
6,105,162 A 8/2000 Douglas et al.
6,119,267 A 9/2000 Pozzi
6,122,769 A 9/2000 Wilder et al.
D431,691 S 10/2000 Redwood et al.
6,182,289 B1 2/2001 Brown
6,185,747 B1 2/2001 Hughes
6,216,276 B1 4/2001 Eibert
6,223,350 B1 5/2001 McFarlane
6,223,744 B1 5/2001 Garon
6,226,795 B1 5/2001 Winningham
6,233,744 B1 5/2001 McDuff
6,249,915 B1 6/2001 Hang
6,253,382 B1 7/2001 Kleinert
6,256,792 B1 7/2001 MacDonald
D445,996 S 8/2001 Kiernan
6,275,996 B1 8/2001 Redwood et al.
6,279,160 B1 8/2001 Chen
6,279,163 B1 8/2001 Hale et al.
6,289,515 B1 9/2001 Fous
6,289,516 B1 9/2001 Motooka et al.
6,321,387 B1 11/2001 Fukae
6,353,931 B1 3/2002 Gilligan et al.
6,378,925 B1 4/2002 Greenlee
6,389,601 B2 5/2002 Kleinert
6,405,380 B1 6/2002 Kuroda et al.
6,415,444 B1 7/2002 Kleinert
6,415,445 B1 7/2002 Nishijima et al.
D461,621 S 8/2002 Bevier
6,427,247 B1 8/2002 Suk
6,430,745 B2 8/2002 Murai
6,453,474 B2 9/2002 Kleinert
D464,178 S 10/2002 Redwood et al.
6,460,184 B1 10/2002 Nishimura et al.
6,487,724 B1 12/2002 Aoki
D468,075 S 1/2003 Votel
6,502,244 B1 1/2003 Kleinert
6,516,470 B1 2/2003 Aoki
6,516,471 B1 2/2003 Baumann
6,519,781 B1 2/2003 Berns
D471,343 S 3/2003 Sun
D471,674 S 3/2003 Redwood et al.
6,526,592 B1 3/2003 Best
6,536,046 B1 3/2003 Gilligan
6,553,576 B1 4/2003 Knapp
D474,863 S 5/2003 Sun
D474,963 S 5/2003 Gersten et al.
6,571,394 B1 6/2003 Hackett et al.
6,584,616 B2 7/2003 Godshaw et al.
6,618,860 B1 9/2003 Sullivan et al.
6,651,255 B1 11/2003 Schild
6,662,942 B1 12/2003 Bonzagni
6,668,379 B2 12/2003 Kleinert
6,681,402 B1 1/2004 Bevier et al.
6,701,530 B2 3/2004 Kleinert
6,704,939 B2 3/2004 Faulconer
6,708,346 B2 3/2004 Terris et al.
6,715,152 B2 4/2004 Mazzarolo
6,721,960 B1 4/2004 Levesque et al.
6,732,377 B1 5/2004 Wilkinson
6,745,402 B2 6/2004 Caswell
6,760,923 B1 7/2004 Tate
6,760,924 B2 7/2004 Hatch et al.
D495,097 S 8/2004 Redwood et al.
6,775,847 B2 8/2004 Terris et al.
D499,529 S 12/2004 Kleinert
D499,856 S 12/2004 Kleinert
6,832,391 B1 12/2004 Bower
6,845,514 B1 1/2005 Yao
6,845,519 B2 1/2005 Garneau
6,862,744 B2 3/2005 Kuroda et al.
6,868,553 B2 3/2005 Kleinert
6,961,960 B2 11/2005 Gold et al.
D513,828 S 1/2006 Bevier
D514,772 S 2/2006 Bevier
7,000,256 B2 2/2006 Kleinert
7,000,257 B2 2/2006 Bevier
D516,277 S 3/2006 Mattesky
D529,236 S 9/2006 Litke et al.
7,100,212 B2 9/2006 Jaeger
D532,162 S 11/2006 Bonzagni et al.
7,171,696 B2 2/2007 Falone et al.
D545,002 S 6/2007 Voravan et al.
D549,398 S 8/2007 Swartz et al.
D554,808 S 11/2007 Litke et al.
D570,056 S 5/2008 Metcalf

(56) References Cited

U.S. PATENT DOCUMENTS

| | | | |
|---|---|---|---|
| 7,406,719 | B2 | 8/2008 | Aoki |
| D581,102 | S | 11/2008 | Faulconer |
| D583,527 | S | 12/2008 | Kleinert |
| D583,528 | S | 12/2008 | Kleinert |
| 7,464,446 | B2 | 12/2008 | Johansson |
| D584,026 | S | 1/2009 | Kleinert |
| D584,027 | S | 1/2009 | Kleinert |
| D595,457 | S | 6/2009 | Kleinert |
| D595,458 | S | 6/2009 | Kleinert |
| D597,728 | S | 8/2009 | Kleinert |
| D598,636 | S | 8/2009 | Kleinert |
| 7,578,006 | B2 | 8/2009 | Garneau |
| D599,960 | S | 9/2009 | Ash et al. |
| D604,027 | S | 11/2009 | Kleinert |
| D612,576 | S | 3/2010 | Toth |
| 7,707,653 | B2 | 5/2010 | Kleinert |
| D617,977 | S | 6/2010 | Toth |
| D637,765 | S | 5/2011 | Singh |
| D640,856 | S | 7/2011 | Rose |
| D651,408 | S | 1/2012 | Farkas |
| 8,096,901 | B2 | 1/2012 | Russotti |
| 8,104,098 | B1 | 1/2012 | Kleinert |
| 8,276,215 | B2 | 10/2012 | Merkle et al. |
| 2001/0025382 | A1 | 10/2001 | Murai |
| 2001/0054190 | A1 | 12/2001 | Kleinert |
| 2002/0013961 | A1 | 2/2002 | Kleinert |
| 2002/0040494 | A1 | 4/2002 | Kleinert |
| 2002/0042940 | A1 | 4/2002 | Kuroda et al. |
| 2002/0152536 | A1 | 10/2002 | Kuroda et al. |
| 2003/0000005 | A1* | 1/2003 | Faulconer ..... 2/161.1 |
| 2003/0005506 | A1 | 1/2003 | Litke |
| 2003/0050586 | A1 | 3/2003 | Domanski et al. |
| 2003/0051285 | A1 | 3/2003 | Bower |
| 2003/0056273 | A1 | 3/2003 | Kleinert |
| 2003/0061651 | A1 | 4/2003 | DeRose, Sr. |
| 2003/0205232 | A1 | 11/2003 | Spitzer |
| 2004/0016038 | A1 | 1/2004 | Motooka et al. |
| 2004/0025226 | A1 | 2/2004 | Jaeger |
| 2004/0025227 | A1 | 2/2004 | Jaeger |
| 2004/0103465 | A1 | 6/2004 | Kleinert |
| 2004/0107476 | A1 | 6/2004 | Goldwitz |
| 2004/0111786 | A1 | 6/2004 | Terris et al. |
| 2004/0123371 | A1 | 7/2004 | Bryant, Sr. |
| 2004/0216207 | A1 | 11/2004 | Anderson |
| 2004/0221365 | A1 | 11/2004 | Fitzgerald |
| 2005/0034213 | A1 | 2/2005 | Bamber |
| 2005/0114982 | A1 | 6/2005 | Gremmert |
| 2006/0026738 | A1 | 2/2006 | Kleinert |
| 2006/0137067 | A1 | 6/2006 | Wu |
| 2006/0195968 | A1 | 9/2006 | Powell et al. |
| 2007/0061943 | A1 | 3/2007 | Kleinert |
| 2007/0083968 | A1 | 4/2007 | Stokes |
| 2007/0150998 | A1 | 7/2007 | Atherton |
| 2007/0150999 | A1 | 7/2007 | Brown |
| 2007/0209097 | A1 | 9/2007 | Iacullo |
| 2007/0226873 | A1 | 10/2007 | Mattesky |
| 2008/0052799 | A1 | 3/2008 | Yoo |
| 2008/0060115 | A1 | 3/2008 | Morris |
| 2008/0141435 | A1 | 6/2008 | Friedman |
| 2008/0263745 | A1 | 10/2008 | Grilliot et al. |
| 2009/0139010 | A1 | 6/2009 | Bevier |
| 2009/0320178 | A1 | 12/2009 | Faulconer |
| 2012/0017351 | A1 | 1/2012 | McCrane |
| 2012/0131715 | A1 | 5/2012 | Copeland et al. |
| 2012/0131716 | A1 | 5/2012 | Copeland et al. |
| 2012/0227158 | A1 | 9/2012 | Ashworth et al. |

FOREIGN PATENT DOCUMENTS

| | | |
|---|---|---|
| JP | 401171849 | 7/1989 |
| JP | 09182825 | 7/1997 |
| JP | 02003020504 | 1/2003 |
| WO | WO-9716085 | 5/1997 |
| WO | WO-03082036 | 10/2003 |

OTHER PUBLICATIONS

Anonymous: "Sportco Source" Internet Article, [Online] Apr. 27, 2006, XP002473014, Retrieved from the Internet: URL: http://web.archive.org/web/20060427131931/http://www.sportco-int.com/baseballgloves.htm> [retrieved on Mar. 17, 2008], p. 9.

Anonymous: "The Coolmax Golf Glove", Internet Article, [Online] Aug. 29, 2006, XP002473015, Retrieved from the Internet: URL: http://web.archive.org/web/20060829123241/http://www.hsc.csu.edu.au/textiles_design/performance/2795/glove.htm> [retrieved on Mar. 17, 2008] the whole document.

European Patent Office (ISA/EP); International Search Report and Written Opinion of the International Searching Authority, or the Declaration; Apr. 10, 2008; pp. 1-20; PCT/US2007/023054; European Patent Office; The Netherlands.

United States Patent and Trademark Office (ISA/US); International Search Report and Written Opinion of the International Searching Authority, or the Declaration; May 9, 2005; pp. 1-8; PCT/US04/31316; U.S. Patent and Trademark Office; Usa.

European Patent Office (ISA/EP); International Search Report and Written Opinion of the International Searching Authority, or the Declaration; Apr. 13, 2007; pp. 1-8; PCT/US2006/038290; European Patent Office; The Netherlands.

European Patent Office (ISA/EP); International Search Report and Written Opinion of the International Searching Authority, or the Declaration; Jan. 23, 2008; pp. 1-12; PCT/US2007/017302; European Patent Office; The Netherlands.

United States Patent and Trademark Office (ISA/US); International Search Report of the International Searching Authority; Jul. 17, 2003; pp. 1-5; PCT/US03/09409; U.S. Patent and Trademark Office; USA.

European Patent Office (ISA/EP); International Search Report; Jun. 22, 2001; pp. 1-3; PCT/US2001/02608; European Patent Office; The Netherlands.

United States Patent and Trademark Office (ISA/US); International Search Report of the International Searching Authority; Apr. 23, 2003; pp. 1-3; PCT/US02/19390; U.S. Patent and Trademark Office; USA.

United States Patent and Trademark Office (ISA/US); International Search Report of the International Searching Authority; Apr. 7, 2005; pp. 1-3; PCT/US03/41488; U.S. Patent and Trademark Office; USA.

European Patent Office; International Search Report and Written Opinion of the International Searching Authority, or the Declaration; International Search Report and Written Opinion for PCT/US2012/027821; Jun. 29, 2012; pp. 1-8; European Patent Office, The Netherlands.

* cited by examiner

CYCLING GLOVE

BACKGROUND OF THE INVENTION (a) Field of the Invention

This invention relates to gloves for the human hand and particularly for the protection of the ulnar and median nerves in the wrist area of the human hand. More particularly, this invention relates to a protective glove for use in sports for applications where the hands of the wearer are exposed to high impact or stress over prolonged periods of time such as, for example, as in the sport of long distance cycling.

(b) Description of Prior Art

Glove construction for protection of the human hand is well known. In addition, there are a number of patents which teach gloves claimed to be particularly useful in the playing of sports. Moreover, there are a number of patents which teach gloves claimed to be particularly useful for long distance cycling and in the protection for the median and ulnar nerves of the human hand. For example, U.S. Pat. Nos. 6,704,939; 6,216,276; and 5,581,809 teach padding used in the palm areas of the hand which are conducive for use in weight lifting and cycling.

The median and ulnar nerves in the hand pass through separate canals within the wrist area of the hands and when the wrist area of the hand is subjected to stress on these nerves over an extended period of time, the nerves can become involved and potentially suffer a condition such as carpal tunnel syndrome. This prolonged exposure to stress is prevalent in long distance cycling.

For example, U.S. Pat. No. 6,006,751 is directed to a glove for allegedly preventing carpal tunnel syndrome and teaches resilient protective padding which extends along opposed sides of the median nerve along the wrist area and into the palm of the wearer.

U.S. Pat. No. 6,845,514 is directed to a glove with pads for protecting the median and ulnar nerve of the hand and teaches devices to hold these pads in place in relation to the median and ulnar nerves. Specifically, the protective pads are positioned so that one of the pads extends along the metacarpals of the thumb in an area distal to the scaphoid and along the metacarpal of the index finger. A second pad extends along the metacarpal of the small finger along the ulnar nerve terminating at the pisiform.

However, there is a continued need for protective gloves which are specifically designed for off loading the stress exerted upon the ulnar and median nerves in the wrist area.

SUMMARY OF THE INVENTION

It is an object of the present invention to provide a glove for use in sports and occupational applications where the hands of the wearer are exposed to hand gripping functions for extended periods of time such as, for example, long distance cycling.

It is another object of the present invention to provide a protective glove which is constructed to enable or facilitate easy closure of the glove when in use.

It is a further object of the present invention to provide a protective glove which includes zones free of padding at selected areas to enhance the closure and use of the glove in a closed or semi-closed condition.

More particularly, the present invention provides a protective glove having a palm side, a dorsal side, a thumb stall, and plurality of finger stalls for receipt of the index finger, the long finger, the ring finger and the small finger, with an opening therein for receiving a person's hand therethrough.

The palm side of the glove is provided with a palmar side panel which includes shock absorbing pads located to be along opposed sides of an ulnar nerve in the wrist area of a human hand. The shock absorbing pads may include a first shock absorbing pad positioned along the medial side to the proximal end of a metacarpal of a little finger of the human hand and adjacent to or over the pisiform in the wrist area and a second shock absorbing pad positioned to be between the median and ulnar nerves in the wrist area of the hand and over a portion of the capitate, the hamate, and the lunate bones in the wrist.

Other objects and advantages of the present invention will appear from the following description and appended claims, reference being had to accompanying drawings forming a part of a specification wherein like reference characters designate corresponding parts in several views.

BRIEF DESCRIPTION OF THE DRAWINGS

A better understanding of the invention will be had upon reference to the following description in conjunction with the accompanying drawings in which like numerals refer to like parts throughout the several views and wherein.

DESCRIPTION OF THE PREFERRED EMBODIMENTS

Figure 1:
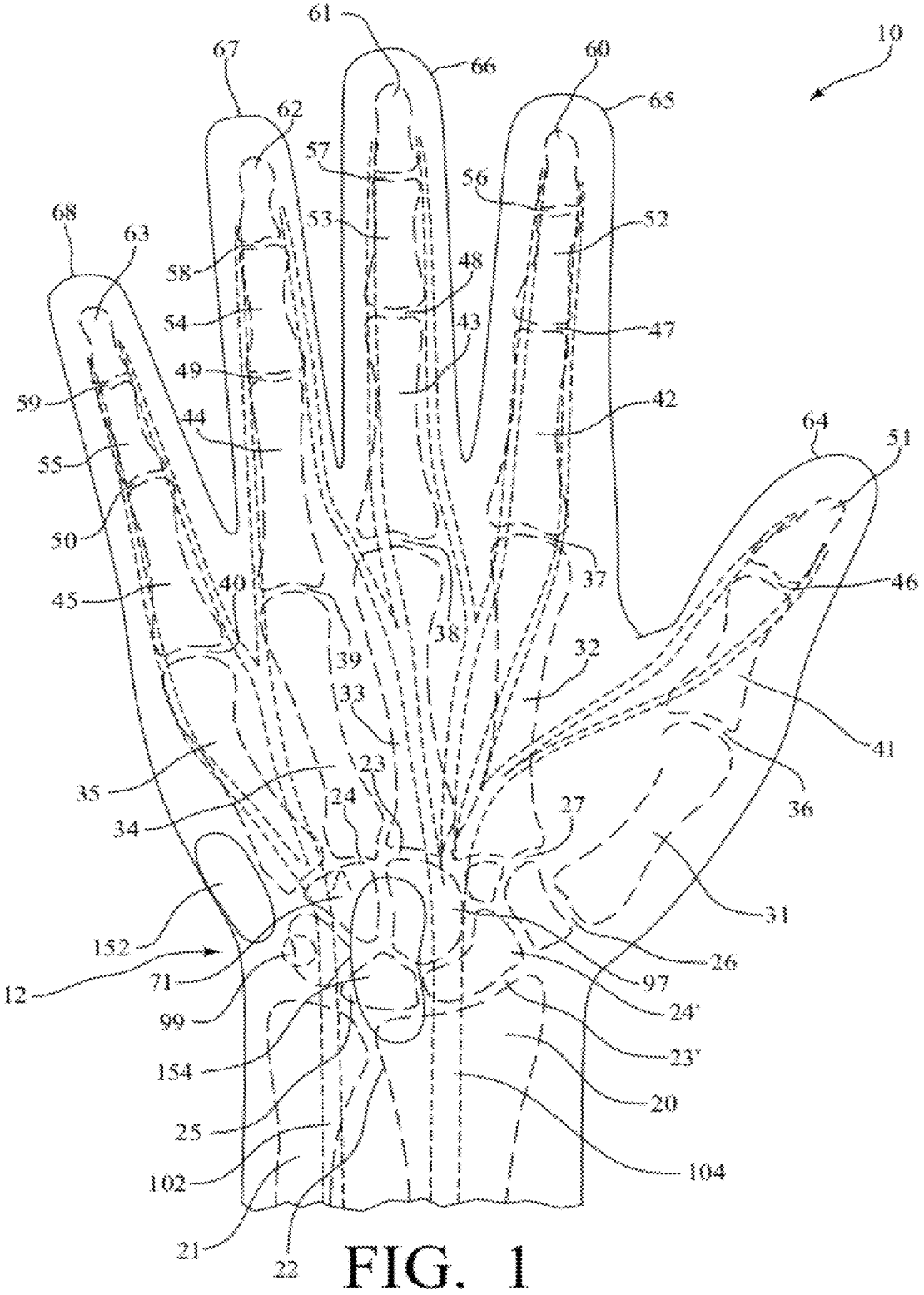
FIG. 1 is a schematic representation of the bones and nerves of the right side human hand shown in palm side detail.

FIG. 1 is a schematic anatomical view of the bones of a right human hand 10 looking at a palm side. Shown are the radius 20, ulna 21, radiocarpal joint (RC) 23', distal radio ulnar joint (DRUJ) 22, wrist 12, thumb 64, index finger 65, long finger 66, ring finger 67, and small finger 68. A carpus comprising eight carpal bones which are shown in FIG. 1 includes the capitate bone 97, the pisiform 99, the hamate bone 71 with its hook-like protrusion, the scaphoid 24' and the lunate 25.

The thumb 64 is comprised of the distal phalanx 51, the interphalangeal joint (IP) 46, proximal phalanx 41, metacarpalphalangeal joint (MCP) 36, metacarpal 31, and carpometacarpal joint (CMC) 26.

The index finger 65 is comprised of the distal phalanx 60, distal interphalangeal joint (DIP) 56, middle phalanx 52, proximal interphalangeal joint (PIP) 47, proximal phalanx 42, metacarpalphalangeal joint (MCP) 37, metacarpal 32, and carpometacarpal joint (CMC) 27.

The long finger 66 is comprised of the distal phalanx 61, distal interphalangeal joint (DIP) 57, middle phalanx 53, proximal interphalangeal joint (PIP) 48, proximal phalanx 43, metacarpalphalangeal joint (MCP) 38, metacarpal 33, and carpometacarpal joint (CMC) 23.

The ring finger 67 is comprised of the distal phalanx 62, distal interphalangeal joint (DIP) 58, middle phalanx 54, proximal interphalangeal joint (PIP) 49, proximal phalanx 44, metacarpalphalangeal joint (MCP) 39, metacarpal 34, and carpometacarpal joint (CMC) 24.

The small finger 68 is comprised of the distal phalanx 63, distal interphalangeal joint (DIP) 59, middle phalanx 55, proximal interphalangeal joint (PIP) 50, proximal phalanx 45, metacarpalphalangeal joint (MCP) 40, and metacarpal 35.

Also as shown in FIG. 1 is a schematic representation of the median and ulnar nerve systems. The median nerve is identified by the numeral 104 and the ulnar nerve is identified by the numeral 102. In the wrist area of the hand, the ulnar nerve 102 is positioned between the pisiform 99 and the lunate 25. Also shown for illustrative purposes is the location for the two shock absorbing pads which are positioned on opposite sides of the ulnar nerve 102 and adjacent to or over the pisiform 99. A first shock absorbing or ulnar protective pad 152 is medial to the ulnar nerve 102 and the second ulnar protective pad 154 is positioned lateral to the ulnar nerve 102 between the ulnar nerve 102 and the median nerve 104. The positioning of pad 152 is along the medial side of the proximal end of the metacarpal 35 of the small finger 68. The positioning for the ulnar protective pad 154 is generally over a portion of the capitate bone 97, the hamate bone 71 and the lunate 25.

Figure 2:
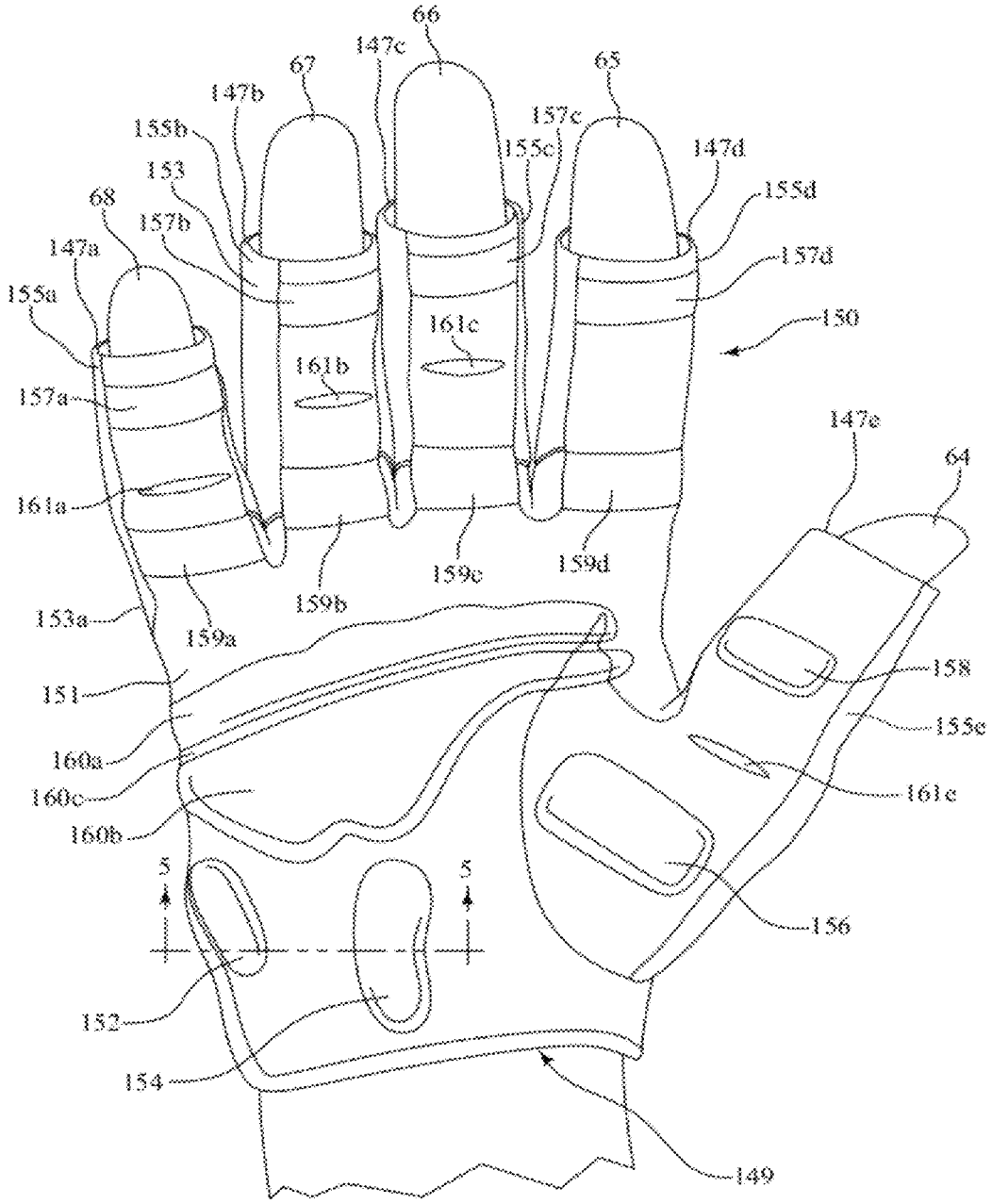
FIG. 2 is a palm side view of a preferred embodiment of the present invention showing the palmar side details of a glove for a right hand.
Figure 2A:
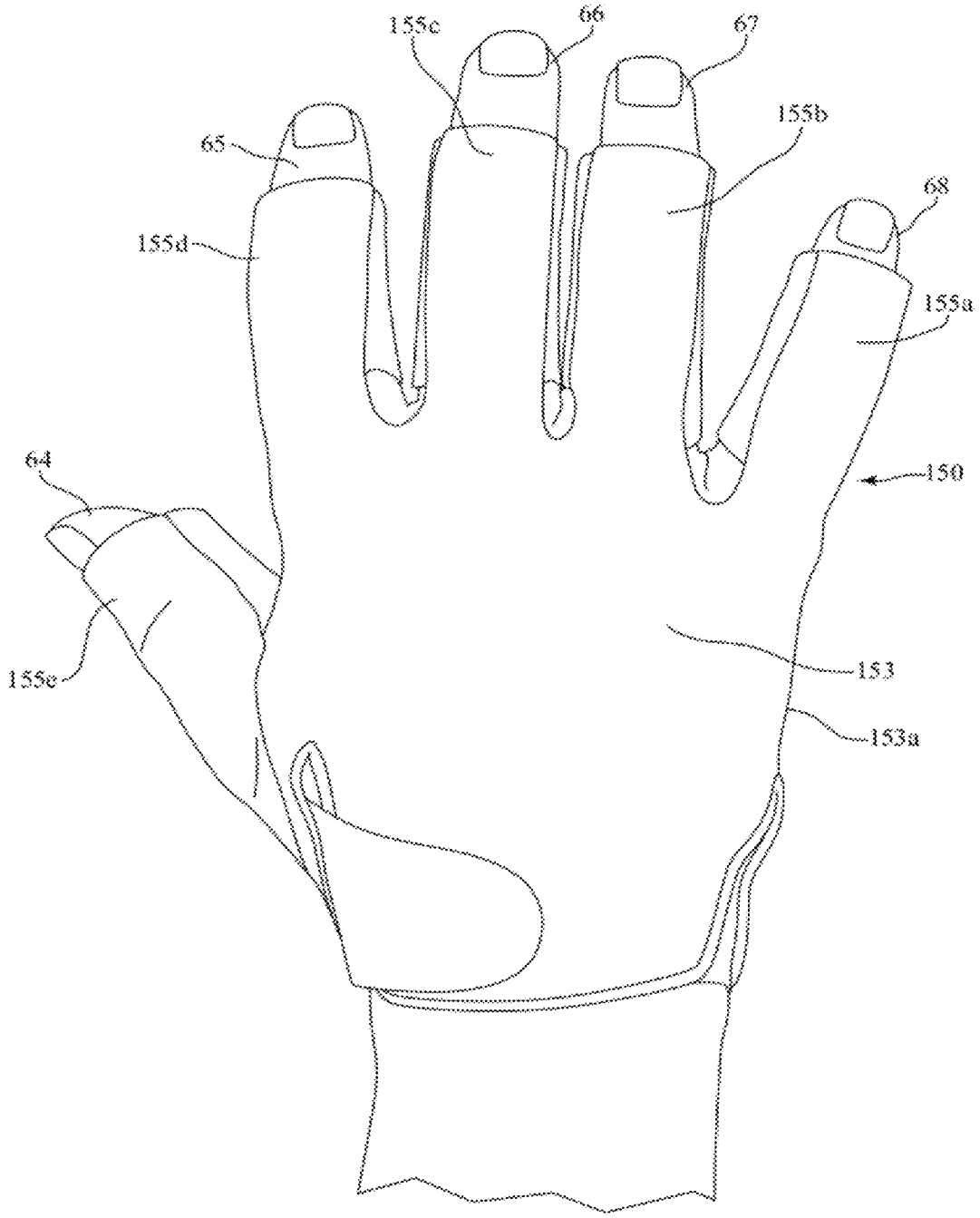
FIG. 2A is a dorsal side view of the glove of FIG. 2.

As best shown in FIG. 2 is a preferred embodiment of a glove 150 of the present invention, particularly useful in cycling or the like. The glove 150 includes a palmar side panel 151 and a dorsal side panel 153 (FIG. 2A). The panels 151 and 153 are attached along opposite sides with an opening 149 therein to receive the hand 10 therethrough. The glove 150 is provided with a plurality of finger and thumb elements 155*a*-155*e*. The finger elements include the small finger element 155*a*, the ring finger element 155*b*, the long finger element 155*c*, the index finger element 155*d* and the thumb element 155*e*. All of the finger and thumb elements 155*a*-155*e* may include open distal ends exemplified as open distal ends 147*a*-147*e* to receive the fingers 65, 66, 67 and 68 of a human hand and the thumb 64 therethrough. The finger and thumb elements 155*a*-155*e* are also provided with padding at selected points therealong to protect the pulleys and tendons of the fingers and thumbs. Protective pads 157*a*, 157*b*, 157*c*, and 157*d* are positioned along the finger elements 155*a*, 155*b*, 155*c* and 155*d*, respectively, between the distal interphalangeal joints 59, 58, 57 and 56 and the proximal interphalangeal joints 50, 49, 48 and 47, respectively. Also as shown in FIG. 2 shock absorbing or protective pads 159*a*, 159*b*, 159*c* and 159*d* are positioned to cover the proximal phalanxes 45, 44, 43 and 42 of the small finger 68, the ring finger 67, the long finger 66, and the index finger 65 respectively, and between the proximal interphalangeal joints 50, 49, 48 and 47 and the metacarpalphalangeal joints 40, 39, 38 and 37. Also provided in the preferred glove 150 are expansion zones in the finger elements 155*a*-155*d* and identified as expansion zones 161*a*, 161*b*, and 161*c*, said expansion zones including a stretchable material positioned to be over the proximal interphalangeal joints 50, 49, and 48, respectively. The palmar side of the glove is also provided with palmar protective pads 160*a* and 160*b* which are positioned to extend across the palmar side of the glove. The palmar protective pads 160*a* and 160*b* are positioned to extend transversely of the metacarpals 35, 34, 33 and 32 to protect the nerves and tendons anterior to the metacarpals 35, 34, 33 and 32. An optional space 160*c* is provided between the pads 160*a* and 160*b* and is positioned to extend transversely across the palmar side of the human hand thereby allowing for easier flexion of the hand upon closure. The metacarpalphalangeal joints 40, 39, 38, and 37 are located between each of the finger pads 159*a* and palm pad 160*a* thereby allowing for unencumbered use of these joints. The thumb element 155*e* is also provided with palmar side padding. A thumb shock absorbing pad 156 proximal to the metacarpalphalangeal joint 36 is provided to protect the metacarpal 31 and thumb shock absorbing pad 158 is provided to protect the nerves, pulleys and tendons along the proximal phalanx 41 distal to the metacarpalphalangeal joint 36. In expansion zone 161*e*, an elastomeric stretchable material is provided over the metacarpalphalangeal joint 36 of the thumb 64. Also, as shown in FIG. 2, the ulnar protective pads 152 and 154 are positioned along opposed sides of the ulnar nerve 102 (FIG. 1).

In FIG. 2A glove 150 includes a dorsal side panel 153 which is attached along its outer periphery 153*a* to the palmar side panel 151 (FIG. 2).

Figure 3:
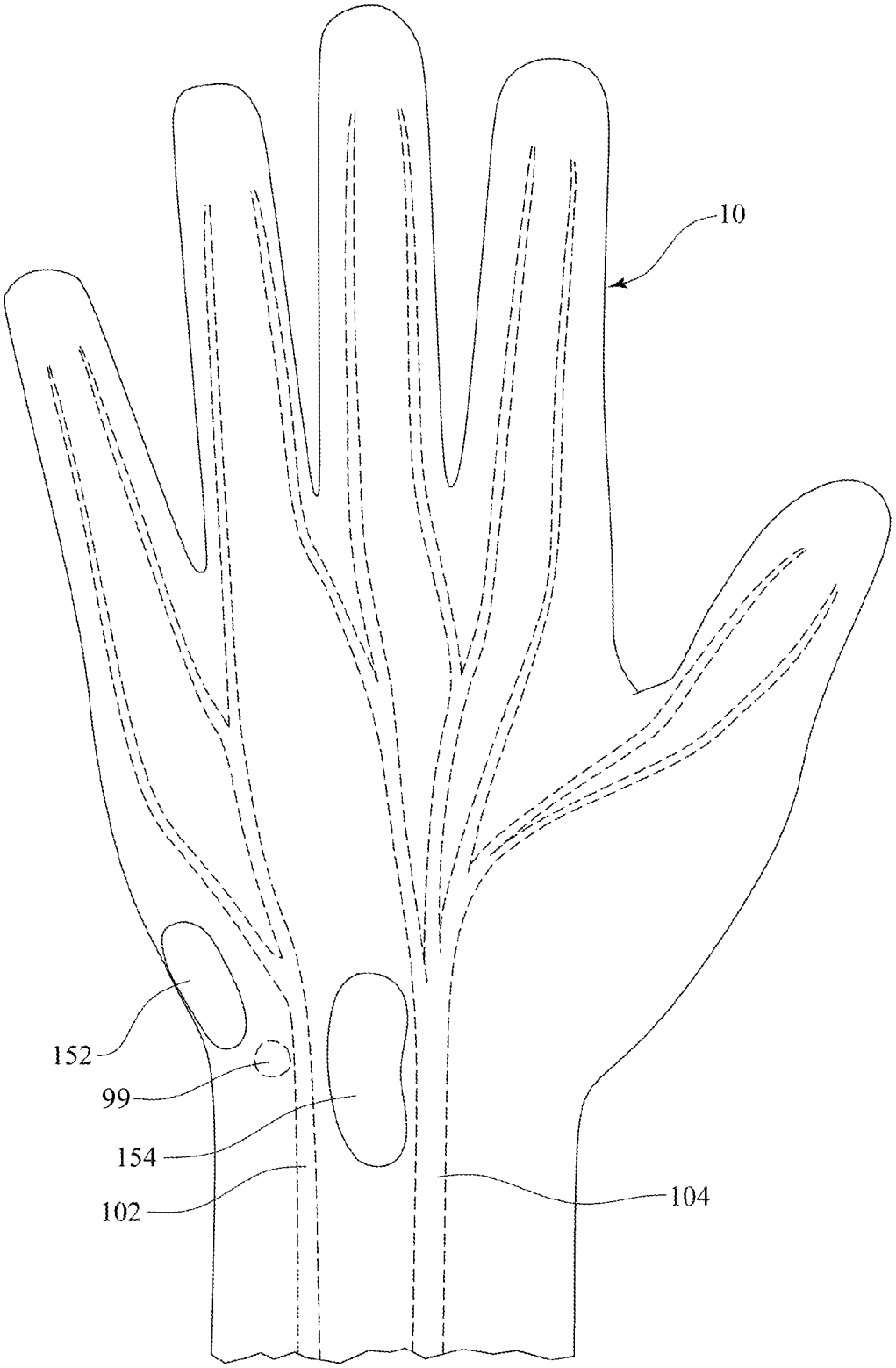
FIG. 3 is a palmar side schematic representation of a right human hand showing the location of the median and ulnar nerves and the protective pad details in relation to these nerves.

As shown in FIG. 3, is a schematic representation of the ulnar nerve 102 and median nerve systems 104 of the human hand 10 and the depiction of the protective paddings and specific location of these protective pads 152, 154 on opposed sides of the ulnar nerve system 102 and the median nerve system 104. As best shown in FIG. 3, the ulnar protective pad 152 is positioned medial to the ulnar nerve 102 along the proximal end and generally along the medial side to the metacarpal 35 of the small finger 68. The proximal terminating end of the ulnar protective pad 152 is adjacent to the pisiform 99 but may extend over the pisiform 99. The ulnar protective pad 154 is generally positioned between the ulnar nerve 102 and the median nerve 104 and, as best shown in FIG. 1, extends over a portion of the capitate 97, the hamate 71, and the lunate 25.

Figure 4:
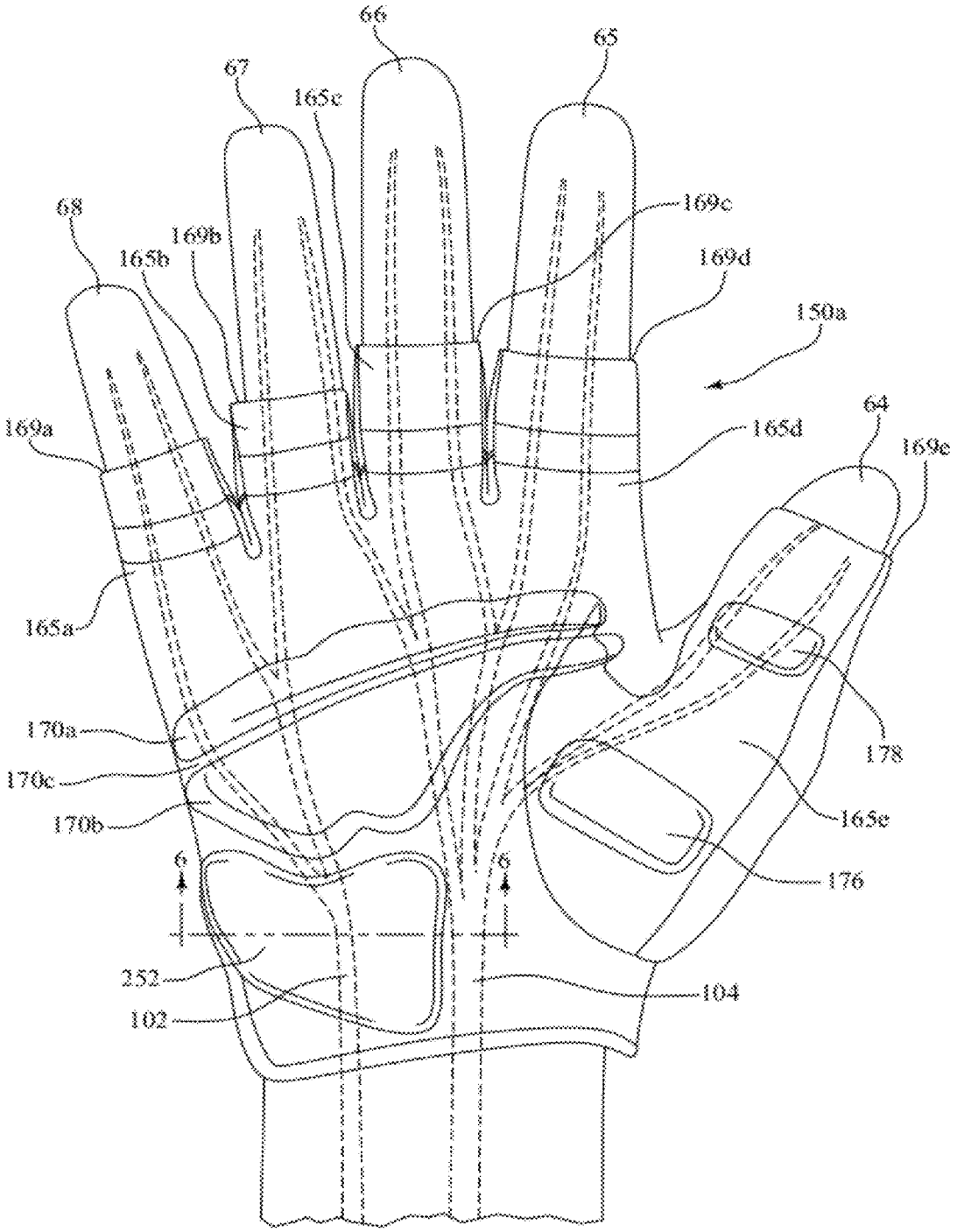
FIG. 4 is a palmar side view of another embodiment of the present invention showing the palmar side details of the glove.
Figure 6:
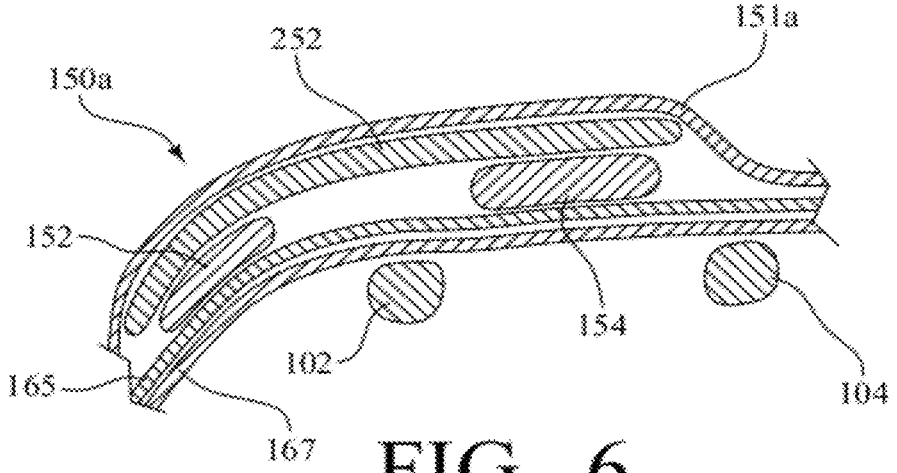
FIG. 6 is a sectional view taken along line 6-6 in FIG. 4.

Shown in FIG. 4 is another preferred embodiment of the present invention which depicts an additional pad 252 which crosses over the ulnar nerve 102, as best shown in FIG. 6 and discussed hereinafter. The glove 150*a* is also provided with a plurality of finger elements 165*a*, 165*b*, 165*c* and 165*d*, as well as a thumb element 165*e*. The finger elements 165*a*, 165*b*, 165*c* and 165*d* are provided with distal openings 169*a*, 169*b*, 169*c* and 169*d* therein to receive fingers 68, 67, 66 and 65 therethrough, respectively. The thumb element 165*e* is also provided with an opening 169*e* in the terminating end thereof to receive a thumb 64 therethrough. Palmar protective pads 170*a* and 170*b* are provided to extend transversely of the metacarpals 35, 34, 33, and 32 proximal to the metacarpalphalangeal joint 40, 39, 38 and 37 of the finger 68, 67, 66 and 65, respectively. A space 170*c* between pads 170*a* and 170*b* is provided to allow easier movement of the metacarpalphalangeal joints of the fingers when in use. The thumb element 165*e* is also provided with thumb protective pads 176 and 178. Protective pad 176 is positioned to extend over the thumb metacarpal 31 proximal to the metacarpalphalangeal joint 36 and protective pad 178 extends over the pulleys and tendons of the proximal phalanx 41 distal to the metacarpalphalangeal joint 36. The ulnar protective pad 252 is provided to overlie the protective pads 152 and 154, as best shown in FIG. 6.

Figure 5:
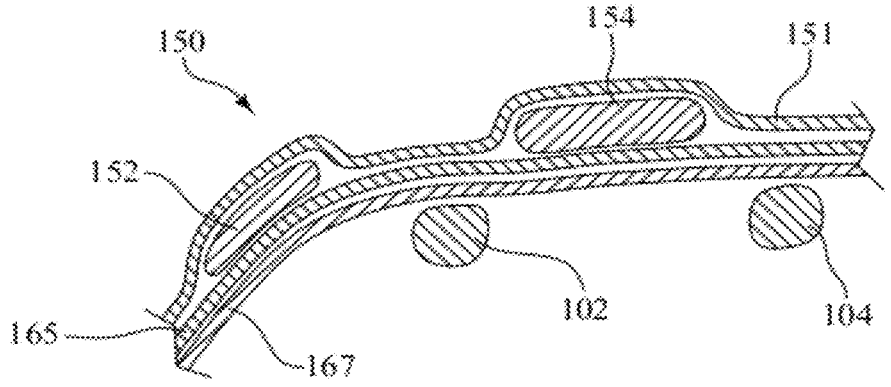
FIG. 5 is a sectional view taken along line 5-5 of FIG. 2.

Referring now to FIG. 5, FIG. 5 is a cross-sectional view of a section of the glove 150 shown in FIG. 2 showing the relationship between the ulnar protective padding 152 and 154 to the ulnar nerve 102 and the median nerve 104 when placed upon the hand of the wearer. Particularly pad 152 extends along the medial side of ulnar nerve 102 and pad 154 is disposed generally between the ulnar nerve 102 and the median nerve 104. As shown in FIG. 5 the glove 150 includes an outer palmar side panel 151 which extends over the ulnar protective pads 152 and 154 and also includes an inner glove lining 165 which is the palmar side inner lining of the glove 150. The outer skin of a wearer is identified by the numeral 167.

Shown in FIG. 6 is a cross-sectional view of the glove 150*a* which is a modification of the glove as depicted in FIGS. 2 and 5. FIG. 6 is a cross-sectional view of the glove of 150*a* as shown in FIG. 4 and particularly illustrates the additional pad 252 which is disposed to extend over the pads 152 and 154 and is spaced from the ulnar nerve 102. In the glove 150*a* an outer palmar side panel 151*a* is provided to cover the ulnar protective pad 252 and an inner palmar side glove lining 165 is also provided.

In a preferred glove, the pads 152 and 154 are between one-eighth (⅛) and one-quarter (¼) of an inch in thickness and generally between one-quarter (¼) and one-half (½) of an inch in width. The pad 252 also has a thickness of about one-eighth (⅛) to one-quarter (¼) inch and is of a sufficient width to extend over the ulnar protective pads 152 and 154.

The gloves 150 and 150*a* are generally constructed of leather or appropriate flexible synthetic materials. The expansion zones in the gloves 150 and 150*a* are covered with stretchable or elastic materials, such as, for example, 2-way SPANDEX® which allows flexion of the joints when in use. The protective padding is generally rubber or any appropriate foam or cushioning material well known for glove padding.

The detailed description is given primarily for clearness of understanding and no unnecessary limitations are to be understood therefrom where modifications will become obvious to those skilled in the art upon reading the disclosure and may be made without departing from the spirit of the invention and the scope of the appended claims.

What is claimed is:

1. A glove comprising:

a palmar side panel and a dorsal side panel secured along each panels outer periphery with an opening therein to receive a human hand; said dorsal side panel being sized to cover the back of said hand and in conjunction with said palmar side panel defining a thumb stall and a plurality of finger stalls for receiving a thumb and fingers of a human hand; said palmar side panel including shock absorbing pads positioned to be along opposed sides of an ulnar nerve in a wrist area of a human hand.

2. The glove of claim 1 said shock absorbing pads including a first ulnar protective pad positioned to be along the medial side of a proximal end of the metacarpal of a little finger of said human hand and at least adjacent to the pisiform in said wrist area and a second ulnar protective pad positioned to be generally between a median nerve and said ulnar nerve in said wrist area of said hand said second ulnar protective pad positioned to be over a portion of the capitate lunate and hamate bones in said wrist area.

3. The glove of claim 2 including palmar protective padding extending over the metacarpals of a plurality of fingers wherein the metacarpalphalangeal joints of said fingers are absent of padding.

4. The glove of claim 2 including palmar side protective padding positioned over the metacarpal of the thumb the metacarpalphalangeal joint being absent of padding.

5. The glove of claim 2 including a third ulnar protective pad positioned to extend over the first and second ulnar protective pads and spaced from said ulnar nerve.

6. The glove of claim 2 said ulnar protective pads having a thickness of from about one-eighth (⅛) inch to one-fourth (¼) inch.

7. The glove of claim 2 including shock absorbing pads positioned to be over proximal phalanges of said fingers and between the proximal interphalangeal joints and the metacarpalphalangeal joints; said joints being absent of padding.

8. The glove of claim 2 said thumb element including shock absorbing padding positioned to be along a metacarpal proximal to a metacarpalphalangeal joint and a proximal phalanx distal to said metacarpalphalangeal joint.

* * * * *